US005087317A

United States Patent [19]

Rogall

[11] Patent Number: 5,087,317

[45] Date of Patent: Feb. 11, 1992

[54] LABELLING MACHINE FOR THE LABELLING OF CONTAINERS

[75] Inventor: Wolfgang Rogall, Wupperttal, Fed. Rep. of Germany

[73] Assignee: ETI-TEC Maschinenbau GmbH, Erkrath, Fed. Rep. of Germany

[21] Appl. No.: 550,321

[22] Filed: Jul. 9, 1990

Related U.S. Application Data

[63] Continuation-in-part of Ser. No. 431,587, Nov. 3, 1989.

[30] Foreign Application Priority Data

Jul. 12, 1989 [DE] Fed. Rep. of Germany ..... 3922934

[51] Int. Cl.[5] ..... B65C 9/00

[52] U.S. Cl. ..... 156/456; 156/446; 156/448; 156/458; 156/566; 156/567; 74/567; 74/448

[58] Field of Search ..... 156/567, 446, 447, 448, 156/451, 456, 458, 566, 568, 578; 74/567, 448

[56] References Cited

U.S. PATENT DOCUMENTS

| | | | |
|---|---|---|---|
| 4,302,277 | 11/1981 | Ilsemann | 156/567 |
| 4,430,141 | 2/1984 | Zodrow | 156/360 |
| 4,531,995 | 7/1985 | Gau | 156/456 |
| 4,594,123 | 6/1986 | Eder | 156/456 |
| 4,721,544 | 1/1988 | Zodrow et al. | 156/456 |
| 4,731,147 | 3/1988 | Mohn | 156/456 |

FOREIGN PATENT DOCUMENTS

| | | |
|---|---|---|
| 3612979 | 10/1987 | Fed. Rep. of Germany . |
| 3622179 | 1/1988 | Fed. Rep. of Germany . |

*Primary Examiner*—David A. Simmons
*Assistant Examiner*—J. Sells
*Attorney, Agent, or Firm*—Nils H. Ljungman & Associates

[57] ABSTRACT

This invention relates to a labelling machine, in particular, a labelling machine for the labelling of objects of different diameters having cylindrical labelling surfaces, such as bottles, which can be moved on rotatable plates of a turntable past a labelling station or a marking station. Each rotatable plate is rotationally controlled by means of a translation transmission by a pivoting control lever arm guided in a stationary cam, whereby the cam has a removable cam segment. A characteristic of the invention is that the cam and the cam segment lie on top of one another at the two interfaces by means of corresponding bevelled surfaces.

16 Claims; 6 Drawing Sheets

LABELLING MACHINE FOR THE LABELLING OF CONTAINERS

CROSS-REFERENCE TO RELATED APPLICATION

This application is a continuation-in-part of co-pending application Ser. No. 07/431,587, filed Nov. 3, 1989 in the name of Wolfgang Rogall, the inventor herein, assigned to the assignee of the present invention, and entitled "Labelling Machine for the Labelling of Containers", which application is incorporated by reference here.

BACKGROUND OF THE INVENTION

1. Field of the Invention

This invention relates to a labelling machine, in particular, a labelling machine for the labelling of objects of different diameters having cylindrical labelling surfaces, such as bottles, which can be moved on rotatable plates of a turntable past a labelling station or a marking station. Each rotatable plate is rotationally controlled by means of a translation transmission by a pivoting control lever arm guided in a stationary cam, whereby the cam has a removable cam segment.

2. Background Information

A labelling machine having these features is disclosed, for example, by German Laid Open Patent Application No. 36 22 179. On this and similar labelling machines, the segment of the cam located next to the labelling station can be removed and replaced, so that a cam segment having a rotational program corresponding to the containers to be labelled can be inserted. The switch from one program to another requires both a conversion process and inventory of an appropriate number of cam segments.

On the labelling machine disclosed German Laid Open Patent application No. 36 22 179, the replaceable cam segment fits into the corresponding recess in the cam, forming a butt joint interface. Jerking movements are caused if the cam roller, when running past the interface, jumps out of the cam path in the cam into the cam path of the cam segment. As a result of dimensional tolerances, an offset is unavoidably formed in the path at the intersection of the cam and the cam segment. At the interface, a dimensional variance in the form of a recess or a projection leads to a step or shoulder in the cam path. When the cam roller passes the interface, any differences in height in the course of the cam path causes a jerk-like divergence in the movement of the cam roller. This leads to an increase in wear of the cam rollers and the cam path, and is also extremely undesirable as it prohibits a precise application of a label at the label station, which is generally located a short distance beyond the interface. The uniform movement of the bottle rotatable plate being guided by the cam roller is disrupted, leading to vibrations which are transmitted to the bottle. The proper application of the label is therefore no longer guaranteed.

OBJECT OF THE INVENTION

The object of the invention therefore is to reduce the wear at the interface between the cam and the cam segment on account of the above-mentioned conditions on the cam path and the cam rollers, and simultaneously to guarantee a smooth and undisrupted transition of the cam roller from the cam path in the cam into the cam path in the cam segment.

SUMMARY OF THE INVENTION

This object is achieved by means of a labelling machine in which the cam and the cam segment lie above one another at the two interfaces by means of corresponding bevelled surfaces. The bevelled surfaces of the cam and cam segment are inclined in a plane running transverse to the cam path.

It is preferable that the cut edges of the bevelled surfaces running transverse to the cam path are secant segments of the circle described by the cam. These cut edges therefore diverge from the radial direction. During the transition of a cam roller at the interface from the cam path in the cam segment into the cam path in the cam, or vice versa, the cam roller does not pass over the interfaces in the opposite lateral edges of the cam path simultaneously, but one after the other, and is thus guided more smoothly. This effect is further increased if, in accordance with an additional preferred configuration of the labelling machine according to the invention, there are two coaxial cam rollers, as is also the case with the generic labelling machine. In that case, the transition of the cam rollers on the bevelled interfaces is even more gradual and thus even smoother. On account of the bevelling of the end surfaces of the cam and of the cam segment, first the one roller arrives at the interface, and while it passes the interface, the other roller is still being guided in the old cam path, while when the second cam roller arrives at the interface, the first roller which has already crossed over into the new cam path has taken over the guidance. Here, therefore, there is a continuous guidance and an extraordinarily smooth and gradual transition of the cam rollers from the one cam path, e.g. in the cam, into the next cam path, e.g. in the cam segment. Since the cam rollers are in continuous contact with the lateral edges of the cam path and each cam roller always remains rotating int he same direction, only a little wear is caused by the rolling friction resulting from the rolling of the cam rollers on the cam path. Moreover, there is no disruption of the uniform movement of the bottle rotatable plate which is transported by the cam rollers, so that a very precise and smooth application of labels from the labelling station is achieved.

The replacement of a cam segment when the bottle diameter changes is at least as simple as the replacement of the cam segment of the prior art disclosed in German Laid Open Patent Application No. 36 22 179, in which the surfaces of the butt joint interface run vertical and perpendicular to the cam path.

In accordance with an additional preferred configuration of the labelling machine according to the invention, the lateral edges of the cam path are machined in the lower half for the lower cam roller and are correspondingly machined in the upper half for the upper cam roller.

Consequently, a defined contact of the cam rollers against the lateral edges of the cam path is achieved, and there is a retention of the direction of rotation of the rollers, resulting in a reduction of the wear on the rollers and the lateral edges of the cam path.

One aspect of the invention resides broadly in a labelling machine for labelling a container or the like, the labelling machine comprising: a rotatable turntable for receiving and positioning container for labelling; a labelling station adjacent to the rotatable turntable; a pivoting control lever arm for rotationally controlling each rotatable plate; a cam for guiding the pivoting lever arm; the cam comprising two segments; one cam segment being removable from the other cam segment; each cam segment has two ends; and at least one end of each cam segment overlaps an end of the other cam segment.

Another feature of the invention resides broadly in a cam assembly for a labelling machine for labelling a container or the like, the labelling machine comprising: a rotatable turntable for receiving and positioning containers for labelling; a labelling station adjacent to the rotatable turntable; a pivoting control lever arm for rotationally controlling each rotatable plate; the cam assembly for guiding the pivoting lever arm; the cam assembly comprising two segments; one cam segment being removable from the other cam segment; each cam segment has two ends; and at least one end of each cam segment overlaps an end of the other cam segment.

BRIEF DESCRIPTION OF THE DRAWINGS

The invention is explained in greater detail below with reference to the accompanying drawings.

In the various illustrations, identical parts are designated by the same reference numbers.

DESCRIPTION OF THE PREFERRED EMBODIMENTS

Figure 1:
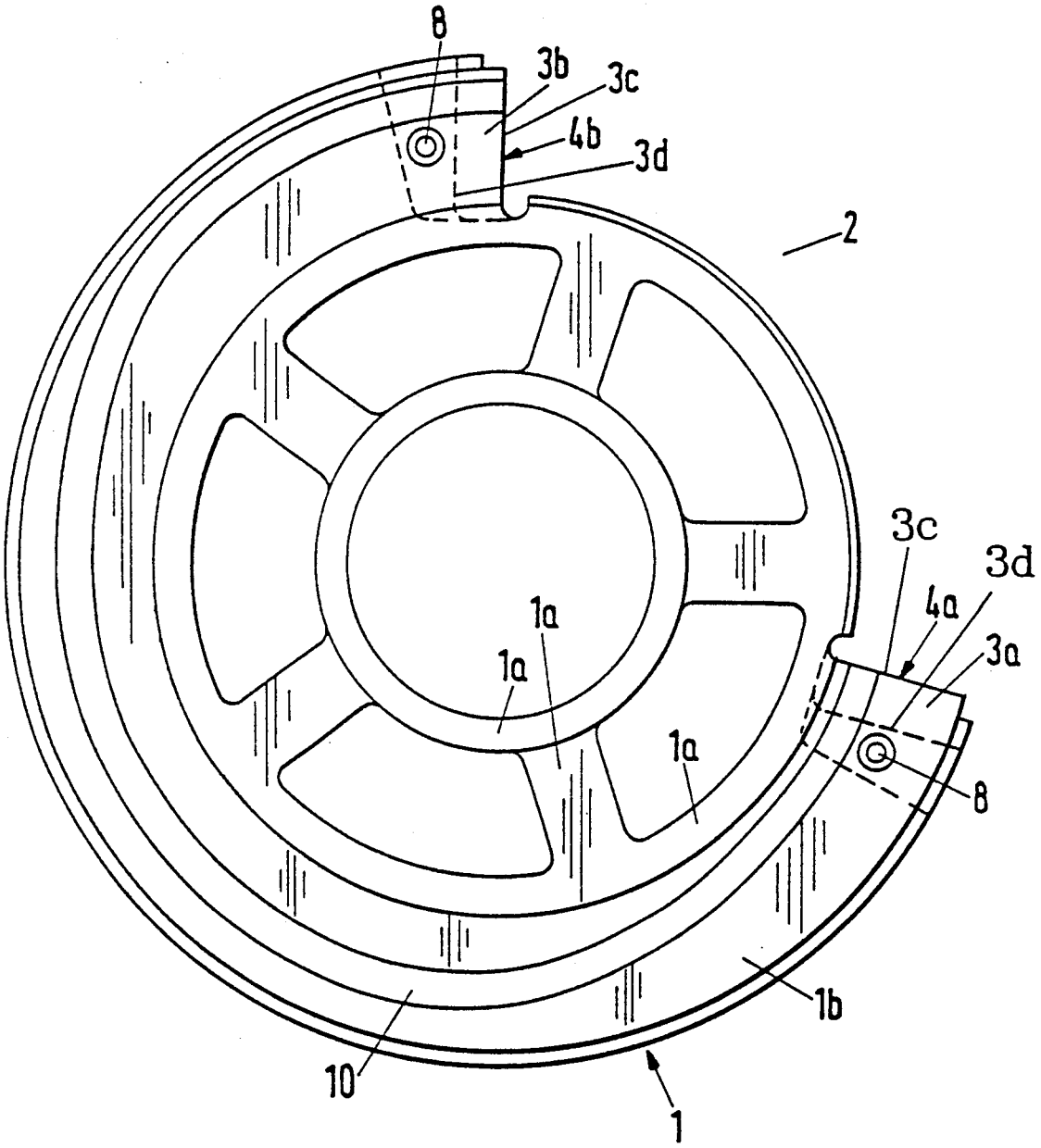
FIG. 1 shows section 1 of the cam as a single piece, in a plan view.
Figure 1A:
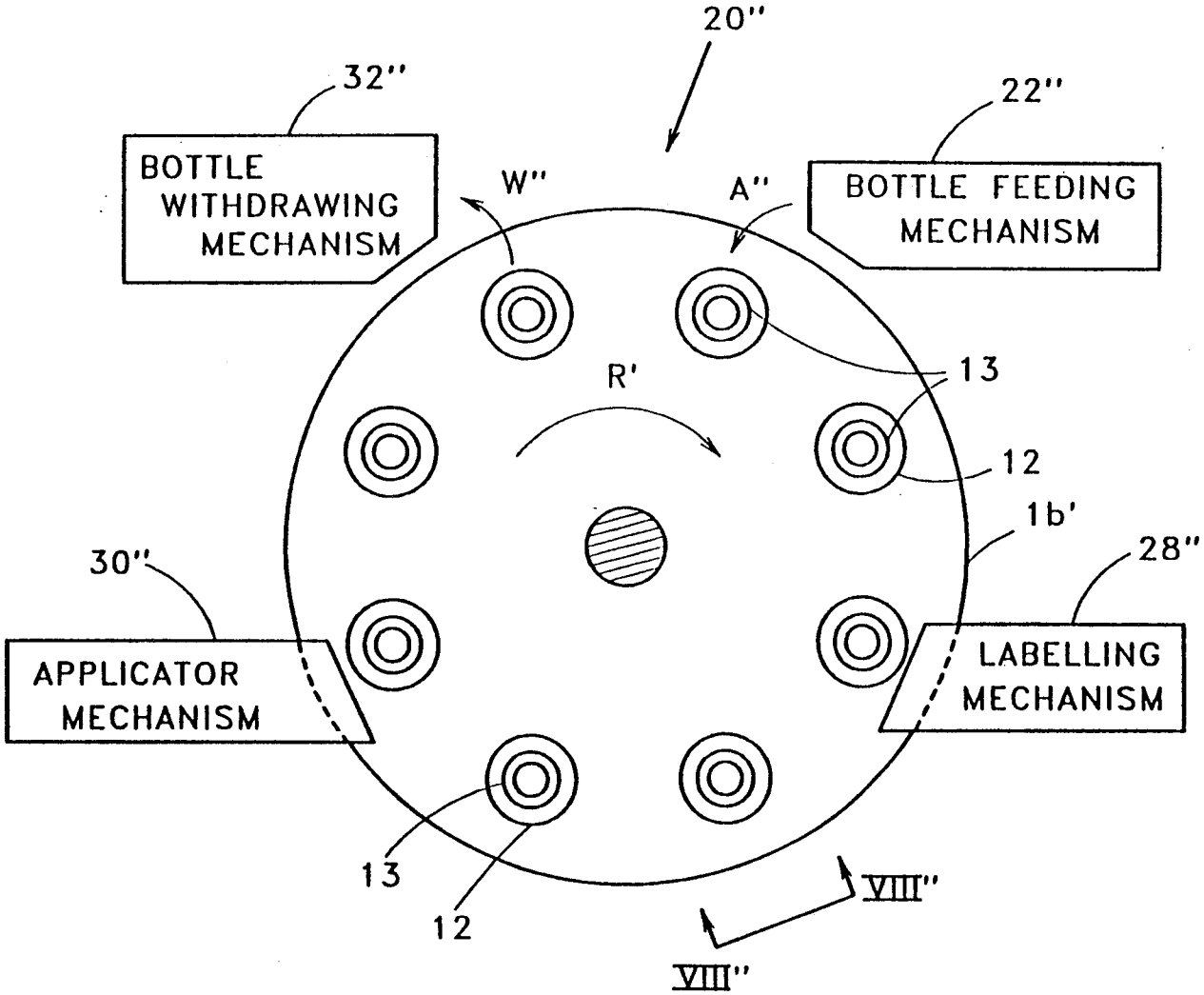
FIG. 1*a* shows a schematic top view of a labelling machine.

In FIG. 1*a*, a bottle is positioned on a rotatable plate 12 by a bottle feeding mechanism 22″. Rotation R′ of table 1*b*′ then moves the bottle 13 past a series of stations, herein depicted as a labelling mechanism 28″ and an applicator mechanism 30″. The bottle 13 is then removed from the rotatable plate 12 by a bottle withdrawing mechanism 32″.

Figure 1B:
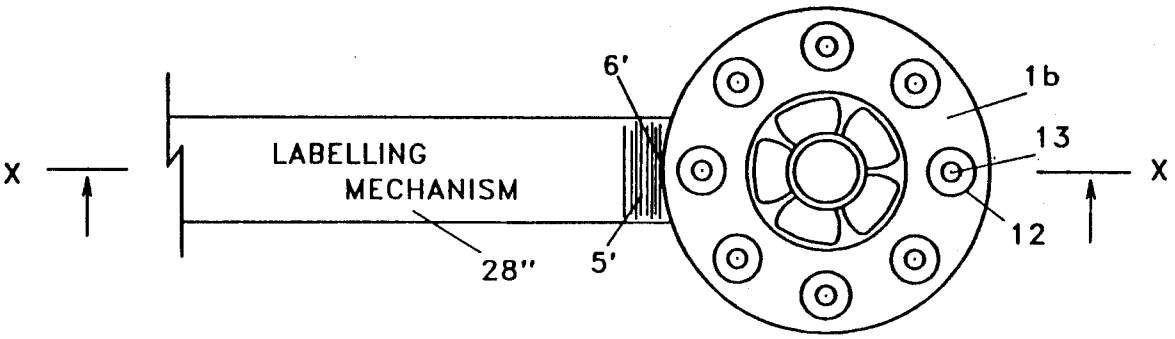
FIG. 1*b* shows a simplified partial top view of a labelling machine.

In FIG. 1*b*, rotatable table 1*b*′ moves bottles 13 past a stack of labels 5′ in the labelling mechanism 28″. As the bottles are moving past the labelling mechanism 28″, the rotatable plate 12 spins the bottle 13 past the labels 5′ at which point a front label 6′ is removed and wrapped around the bottle 13.

Figure 1C:
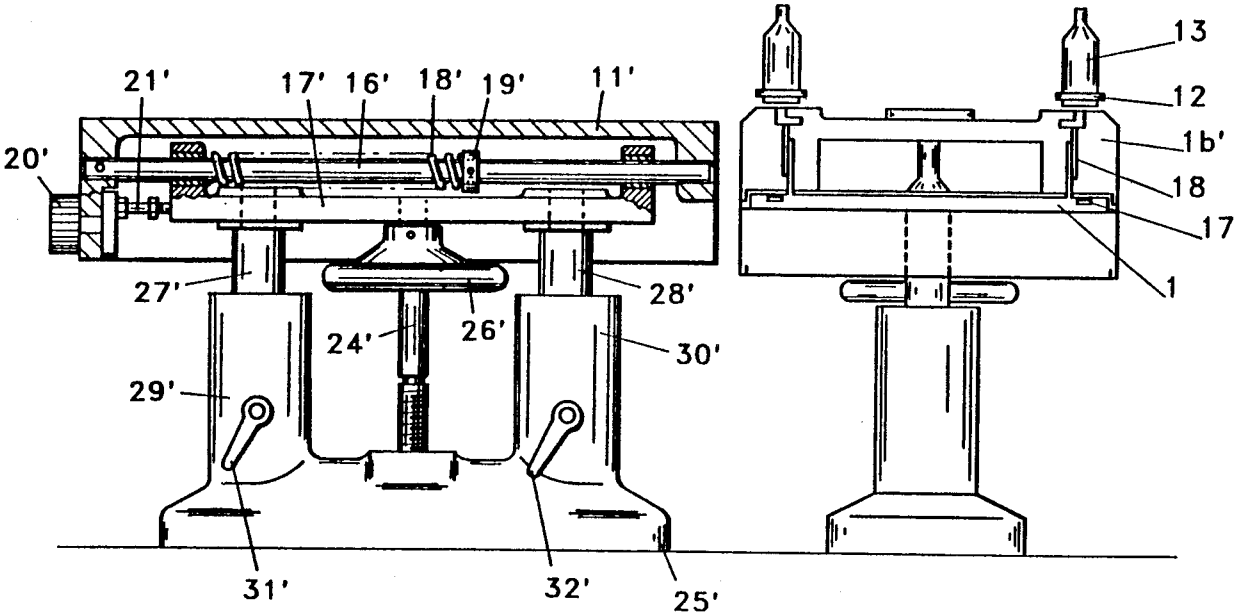
FIG. 1*c* shows a cross-sectional view of the labelling station in FIG. 1*b* along the line X—X.

In FIG. 1*c*, the spinning motion of the plates is guided by a pivoting lever arm 18 which is in turn guided in a groove 17 of cam 1.

The cam 1 illustrates in FIG. 1 with a central segment 1*a* in the form of a bearing bracket and a peripheral ring segment 1*b*, has a ring-segment-shaped cutout 2 extending over a portion of its circumference. At the interfaces 4*a* and 4*b* of the ring-segment-shaped cutout are bevelled surfaces 3*a* and 3*b*.

Figure 2:
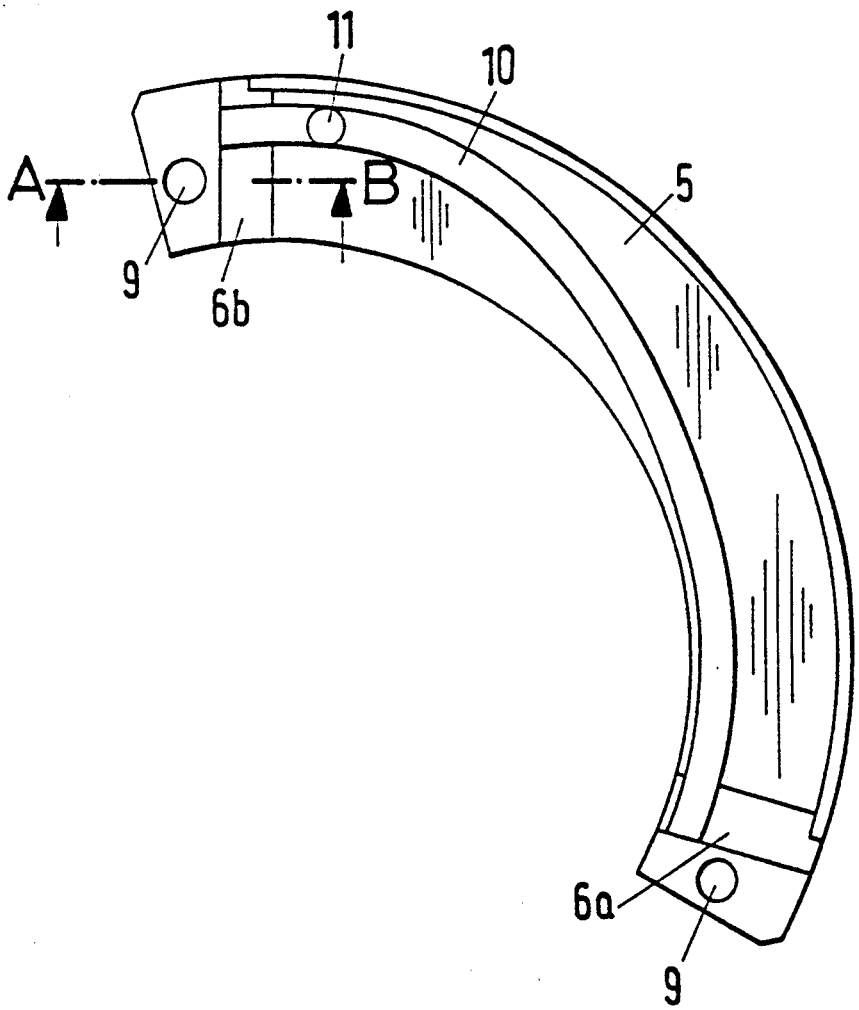
FIG. 2 shows a cam section insertable into slot 2 of the cam in FIG. 1 as a single piece, in a plan view.

The cam segment 5 which fits into the cutout 2 in the cam 1 is illustrated in FIG. 2. It consists of a ring segment, whose circumferential end has appropriately configured bevelled surfaces 6*a*, 6*b*. "Appropriately configured" in this case means that they are complementary with the same slope, such that the bevelled surfaces 3*a*, 3*b* of the cam and the bevelled surfaces 6*a*, 6*b* of the cam segment lie above one another at the interfaces 4*a*, 4*b*, at a slight distance from one another, if necessary, on account of the dimensional tolerances, as shown in FIG. 3.

The cam segment 5 can be inserted into and removed from the cutout section 2 of the cam 1 by means of screws 7, which run through the hole 8 in cam 1 and the hole 9 in cam segment 5.

Worked or machined into the cam segment 5 there is a cam path 10, in which the cam rollers 11*a*, 11*b* are guided. The cam rollers 11*a*, 11*b* are oriented coaxially, and form the guide for the bottle rotatable plate 12 as it spins in the labelling machine, while with the bottle 13 clamped in it, it is moved past the labelling station 28″ for the application of a label 6′. To achieve a clean application of a label on the bottle, i.e. without the labels fanning out or wrinkling, the circumferential velocity of the outer edge of the bottle to be labelled must be synchronized with the velocity at which the bottle moves past the labelling mechanism. If bottles of a different diameter must be labelled, another cam segment must be installed on account of the resulting change in the circumferential velocity.

Figure 3:
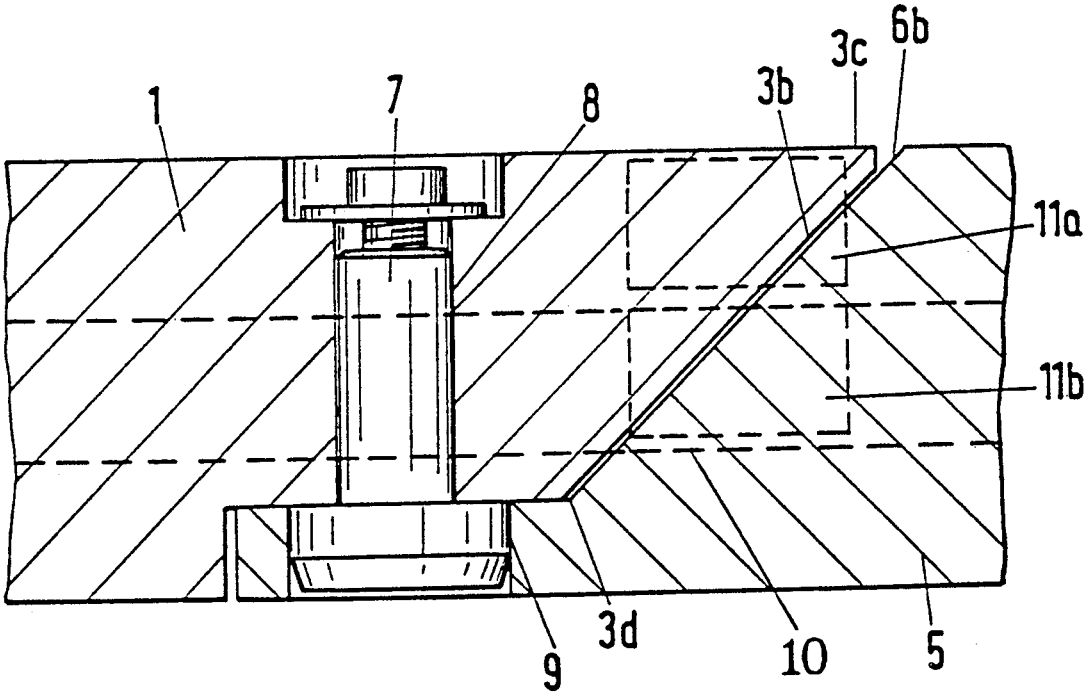
FIG. 3 shows Section A–B from FIG. 2, when the cam section of FIG. 2 is in place in the cam section of FIG. 1.
Figure 4:
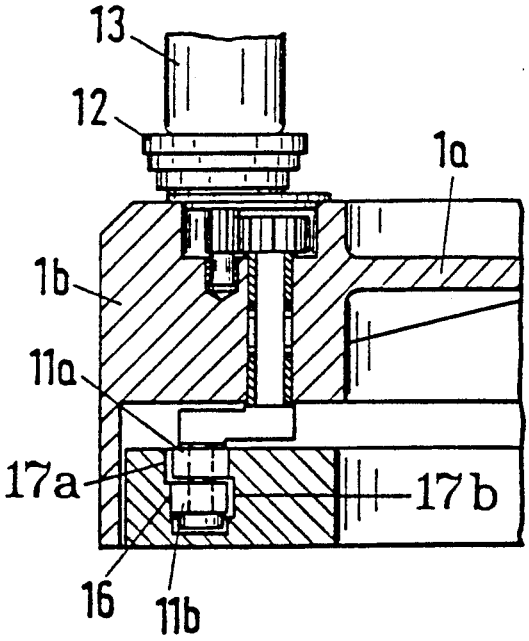
FIG. 4 shows an enlarged section of FIG. 1*c* depicting the drive mechanism.

FIG. 3 shows that with a movement of the pair of cam rollers to the right, first the lower cam roller 11*b* arrives in the vicinity of the interface 4. With the bevel selected for the bevelled surfaces 3 or 6 of approximately 45 degrees from the horizontal, the lower cam roller 11*b* in contact with the lateral edge 16 of the cam path 10 has passed the interface 4 before the upper cam roller 11*a* has reached it. In this position (FIG. 3), the upper cam roller 11*a* is still in contact with the lateral edge of the cam 1, while the lower cam roller 11*b* is already in contact with the lateral edge 16 of the cam segment 5. As a result of this "double contact", irregularities in the transitional area of the lateral edges of the cam path 10 can be "smoothly" bridged, i.e. a step or shoulder in the cam path will not disrupt the movement of the cam rollers as they pass the interface. To guarantee a defined contact of the cam rollers 11*a*, 11*b* with the lateral edges 16 of the cam path 10, the lateral edges shown in FIG. 4 are machined diametrically opposite, so that the upper roller 11*a* is in contact with the one lateral edge 17*a* of the cam path 10, and the lower roller 11*b* is in contact with the opposite lateral edge 17*b*. In this manner, a defined direction of rotation of the cam roller 11 is guaranteed, and increased wear caused by changes in the direction of rotation are avoided, such as would otherwise occur with the cam rollers travelling back and forth in the cam path.

As shown in FIGS. 3 and 4, the cut edges 3*c*, 3*d* of the bevelled surfaces 3*a*, 3*b* running transverse to the cam path 10 and correspondingly the other bevelled surfaces 6*a*, 6*b* diverge at an angle from the radial direction inside the circle described by the cam 1, and therein form a secant segment.

In summary, one feature of the invention resides broadly in a labelling machine, in particular for labelling objects of different diameters having cylindrical labelling surfaces, such as bottles. The bottles being moved on rotatable plates of a turntable past a labelling station or a marking station, whereby each rotatable plate is rotationally controlled in particular by means of a translation transmission by a pivoting control lever arm. The lever arm is guided in a stationary cam 1, which has a removable cam segment 5, wherein the cam 1 and the cam segment 5 lie on top of one another at the two interfaces 4*a*, 4*b* with corresponding bevelled surfaces 3*a*, 3*b* and 6*a*, 6*b*.

Another feature of the invention resides broadly in a labelling machine wherein the cut edges of the bevelled surfaces 3*a*, 3*b* and 6*a*, 6*b* which run transverse to the cam path 190 are secant segments of the circle described by the cam 1.

Yet another feature of the invention resides broadly in a labelling machine having two coaxial cam rollers 11*a* and 11*b*.

A further feature of the invention resides broadly in a labelling machine wherein the lateral edges 17 of the cam path 10 are machined in the lower half for the one cam roller 11*b* and correspondingly in the upper half for the other cam roller 11*a*.

All, or substantially all, of the components and methods of the various embodiments may be used with at least one embodiment or all of the embodiments, if any, described herein.

All of the patents, patent applications, and publications recited herein, if any, hereby incorporated by reference as if set forth in their entirety herein.

The details in the patents, patent applications, and publications may be considered to be incorporable, at apllicant's option, into the claims during prosecution as further limitations in the claims to patentably distinguish any amended claims from any applied prior art.

The invention as described hereinabove in the context of the preferred embodiment is not to be taken as limited to all of the provided details thereof, since modifications and variations thereof may be made without departing from the spirit and scope of the invention.

What is claimed is:

1. A labelling machine for labelling a container or the like, said labelling machine comprising:

a rotatable turntable having rotatable plates disposed thereon; said rotatable plates for receiving and positioning containers for labelling;

at least one labelling means adjacent to said rotatable turntable;

means for rotationally controlling each said rotatable plate;

said means for rotationally controlling each said rotatable plate comprising a pivoting control lever arm means;

cam means for guiding said lever arm means;

said cam means comprising a first cam segment and a second cam segment;

said second cam being removable from said first cam segment;

each of said first cam segment and said second cam segment having two end;

at least one of said ends of said first cam segment and said second cam segment comprising at least one overlapping means for overlapping at least one of said ends of the other one of said first cam segment and said second cam segment; and said at least one overlapping means in formed by at least one bevelled surface on said first cam segment and at least one bevelled surface on said second cam segment.

2. The labelling machine according to claim 1, wherein;

said cam means has an outer edge, said outer edge defining a circle; and said cam means has a cam path means disposed generally annular to said circle.

3. The labelling machine according to claim 2, wherein said cam path means has a transverse direction across said cam path means;

said at least one bevelled surface of said first cam segment and said at least one bevelled surface of said second cam segment have edges, said edges being disposed substantially in said transverse direction of said cam path means; and said edge being disposed along secant segments of said circle.

4. The labelling machine according to claim 3, wherein said lever arm means includes two coaxial cam rollers, said coaxial cam rollers comprising a lower coaxial cam roller and an upper coaxial cam roller.

5. The labelling machine according to claim 4, wherein said cam path means further comprises an upper cam path and a lower cam path;

said lower cam path having a machined outer lateral edge for making contact with said lower coaxial cam roller; and said upper cam path having a machined inner lateral edge for making contact with said upper coaxial cam roller.

6. The labelling machine according to claim 5, wherein said labelling means comprises:

an adhesive station adjacent said rotatable turntable, said adhesive station for applying adhesive to a container to be labelled;

transferring means for transferring labels from a label storage area to a container to be labelled; and a labelling station adjacent said rotatable turntable, said labelling station for placing a label on a container to be labelled.

7. The labelling machine according to claim 1, wherein said labelling means comprises a marking station adjacent said rotatable turntable, said marking station for marking a container.

8. The labelling machine according to claim 7, wherein;

said cam means has an outer edge, said outer edge defining a circle; and said cam mean has a cam path means disposed generally annular to said circle.

9. The labelling machine according to claim 8, wherein said cam path means has a transverse direction across said cam path means;

said at least one bevelled surface of said first cam segment and said at least one bevelled surface of said second cam segment have edges, said edges being disposed substantially in said transverse direction of said cam path means; and said edges being disposed along secant segments of said circle.

10. The labelling machine according to claim 9, wherein said lever arm means includes two coaxial cam rollers, said coaxial cam rollers comprising a lower coaxial cam roller and an upper coaxial cam roller.

11. The labelling machine according to claim 10, wherein said cam path means further comprises an upper cam path and a lower cam path;

said lower cam path having a machined outer lateral edge for making contact with said lower coaxial cam roller; and said upper cam path having a machined inner lateral edge for making contact with said upper coaxial cam roller.

12. A cam assembly for a labelling machine for labelling a container or the like, said labelling machine comprising:

a rotatable turntable having rotatable plates disposed thereon; said rotatable plates for receiving and positioning containers for labelling;

at least one labelling means adjacent to said rotatable turntable;

means for rotationally controlling each said rotatable plate;

said means for rotationally controlling each said rotatable plate comprising a pivoting control lever arm means;

said cam assembly for guiding said liver arm means;

said cam assembly comprising a first cam segment and a second cam segment;

said second cam segment being removable from said first cam segment;

each of said first cam segment and said second cam segment having two ends;

at least one of said ends of said first cam segment and said second cam segment comprising at least one overlapping means for overlapping at least one of said ends of the other one of said first cam segment and said second cam segment; and said at least one overlapping means is formed by at least one bevelled surface on said first cam segment and at least one bevelled surface on said second cam segment.

13. The cam assembly for a labelling machine according to claim 12, wherein;

said cam assembly has an outer edge, said outer edge defining a circle; and said cam assembly has a cam path means disposed generally annular to said circle.

14. The cam assembly for a labelling machine according to claim 13, wherein said cam path means has a transverse direction across said cam path means;

said at least one bevelled surface of said first cam segment and said at least one bevelled surface of said second cam segment have edges, said edges being disposed substantially in said transverse direction of said cam path means; and said edges being disposed along secant segments of said circle.

15. The cam assembly for a labelling machine according to claim 14, wherein said lever arm means includes two coaxial cam rollers, said coaxial cam rollers comprising a lower coaxial cam roller and an upper coaxial cam roller.

16. The cam assembly for a labelling machine according to claim 15, wherein said cam path assembly further comprises an upper cam path and a lower cam path;

said lower cam path having a machined outer lateral edge for making contact with said lower coaxial cam roller; and said upper cam path having a machined inner lateral edge for making contact with said upper coaxial cam roller.

* * * * *

UNITED STATES PATENT AND TRADEMARK OFFICE

CERTIFICATE OF CORRECTION

PATENT NO. : 5,087,317

DATED : February 11, 1992

INVENTOR(S) : Wolfgang ROGALL

It is certified that error appears in the above-identified patent and that said Letters Patent is hereby corrected as shown below:

In column 1, line 38, after 'disclosed', insert --in--.

In column 2, line 39, after 'rotating', delete "int he" and insert --in the--.

In column 3, line 44, after 'bottle', insert --13--.

In column 5, line 9, after 'path', delete "190" and insert --10--.

In column 5, line 24, after 'any,', insert --are--.

In column 5, line 52, after the first occurrence of 'cam', insert --segment--.

In column 5 line 55, after 'two', delete "end" and insert --ends--.

In column 6 line 11, after 'said', delete "edge", and insert --edges--.

In column 6 line 44, after the first occurrence of 'cam', delete "mean" and insert --means--.

In column 7 line 15, after the second occurrence of 'said', delete "liver" and insert --lever--.

Signed and Sealed this

Tenth Day of August, 1993

*Attest:*

*Attesting Officer*

Michael K. Kirk

MICHAEL K. KIRK

*Acting Commissioner of Patents and Trademarks*